US005890423A

United States Patent [19]

Lih

[11] Patent Number: 5,890,423

[45] Date of Patent: Apr. 6, 1999

[54] PAPER TAPE LOCATING/GUIDING DEVICE OF A BILL TYING MACHINE

[76] Inventor: Hui-O Lih, 2F.,No.3,Lane 538, Chung-Chen Rd., Hsin-Dien, Taipei, Taiwan

[21] Appl. No.: 53,916

[22] Filed: Apr. 1, 1998

[51] Int. Cl.[6] ..... B65B 13/20; B65B 13/04

[52] U.S. Cl. ..... 100/26; 53/589; 100/3

[58] Field of Search ..... 100/3, 8, 25, 26; 53/589

[56] References Cited

U.S. PATENT DOCUMENTS

| | | | |
|---|---|---|---|
| 3,613,557 | 10/1971 | Coleman | 100/26 |
| 3,831,512 | 8/1974 | Johnson | 100/26 |
| 3,939,762 | 2/1976 | Smitherman et al. | 100/26 |
| 4,256,032 | 3/1981 | Davis | 100/26 |

FOREIGN PATENT DOCUMENTS

| | | | |
|---|---|---|---|
| 00 76908 | 4/1983 | European Pat. Off. | 100/26 |
| 910 167 | 11/1962 | United Kingdom | 100/26 |

*Primary Examiner*—Stephen F. Gerrity
*Attorney, Agent, or Firm*—Pro-Techtor International Services

[57] ABSTRACT

A paper tape locating/guiding device of a bill tying machine is disclosed. A tape guiding device is disposed in a housing of the machine. The tape guiding device includes an upper guiding block and two lower guiding blocks arranged into a U-shaped pattern. A bill compressing/sealing mechanism serves to push the lower guiding blocks upward to be close to the upper guiding block so as to define a close space. The inner sides of the upper and lower guiding blocks are respectively formed with inner channels for the paper tape to travel therein. Two opposite L-shaped resilient plates are respectively secured to two sides of the inner channels to define a rail for the paper tape to continuously travel therealong. When the bill tying machine is activated, the paper tape is circulated along the rail. When is paper tape is retrieved for tying the bills, the paper tape can be easily released from the restriction of the resilient plates to complete the bill tying and sealing operation.

3 Claims, 5 Drawing Sheets

PAPER TAPE LOCATING/GUIDING DEVICE OF A BILL TYING MACHINE

BACKGROUND OF THE INVENTION

The present invention relates to a paper tape locating/guiding device of a bill tying machine, including an upper guiding block, two lower guiding blocks and L-shaped resilient plates which together define a rail for the paper tape to continuously travel therealong. When the bill tying machine is activated, the paper tape is circulated along the rail. When is paper tape is retrieved for tying the bills, the paper tape is automatically separated from the rail for tying the bills. The paper tape is retrieved and separated without using any assistant power so that the bills can be accurately and reliably tied up and the structure of the bill tying machine is simplified and the manufacturing cost is reduced.

In a general financial institute, a stack of bills are mostly manually tied up with a tape into a unit. Such procedure is time-consuming and laborious. Moreover, due to difference of experience between different operators, the quality of the tied up bills is often varied. An operator with less experience often fails to accurately tie up the bills so that some of the bills are apt to be drawn out of the unit. A mechanically operated bill tying machine is developed for tying the bills with a plastic tape or tying string. Such plastic tape or string can hardly achieve a sealing effect for the bills and thus still cannot substitute for the paper tape which has larger sealing area. However, till now no satisfactory bills tying machine is available for accurately and reliably tying the bills with the paper tape.

SUMMARY OF THE INVENTION

It is therefore a primary object of the present invention to provide a novel paper tape locating/guiding device of a bill tying machine to eliminate the existing problems of the bill tying operation. According to the present invention, a tape guiding device is disposed in a housing of the machine. The tape guiding device includes an upper guiding block and two lower guiding blocks arranged into a U-shaped pattern. A bill compressing/sealing mechanism serves to push the lower guiding blocks upward to be close to the upper guiding block so as to define a close space. The inner sides of the upper and lower guiding blocks are respectively formed with inner channels for the paper tape to travel therein. Two opposite L-shaped resilient plates are respectively secured to two sides of the inner channels to define a rail and restrict the paper tape to continuously travel therealong. When is paper tape is retrieved for tying the bills, the paper tape can be easily released from the restriction of the resilient plates to complete the bill tying and sealing operation. for the paper tape to continuously travel therealong. When the bill tying machine is activated, the paper tape is circulated along the rail. When is paper tape is retrieved for tying the bills, the paper tape can be easily released from the restriction of the resilient plates to accurately and reliably complete the bill tying and sealing operation. The paper tape is retrieved and separated without using any assistant power so that the structure of the bill tying machine is simplified and the manufacturing cost is reduced.

The present invention can be best understood through the following description and accompanying drawing, wherein:

DETAILED DESCRIPTION OF THE PREFERRED EMBODIMENT

Figure 1:
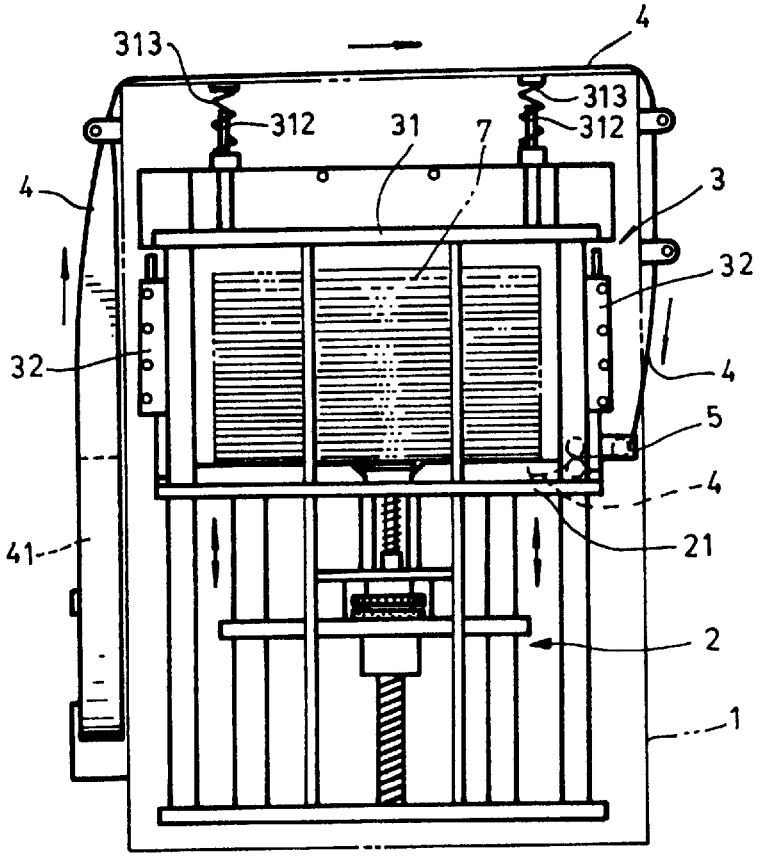
FIG. 1 shows the internal structural arrangement of the present invention.
Figure 2:
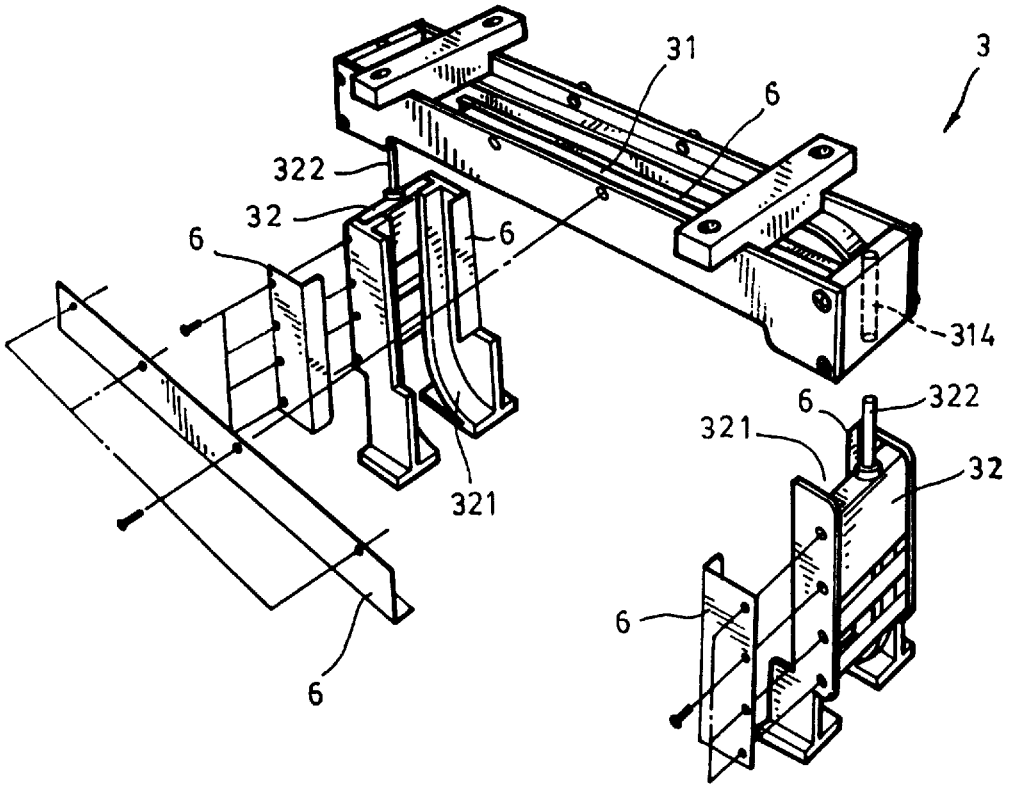
FIG. 2 is a perspective exploded view of the upper and lower guiding blocks of the present invention.

Please refer to FIGS. 1 and 2. The present invention mainly includes a housing 1, a bill compressing/sealing mechanism 2 and a tape guiding device 3. The bill compressing/sealing mechanism 2 pertains to prior art, which serves to push a platform 21 to ascend or descend and seal the paper tape 4. This mechanism 2 is not included in the scope of the present invention and will not be further discussed hereinafter. A tape reel 41 is disposed on one side of the housing 1 for the paper tape to wind therearound. A tape feeding/retrieving mechanism 5 is disposed on the other side of the housing 1, through which the paper tape 4 is passed to enter the tape guiding device 3.

Figure 5:
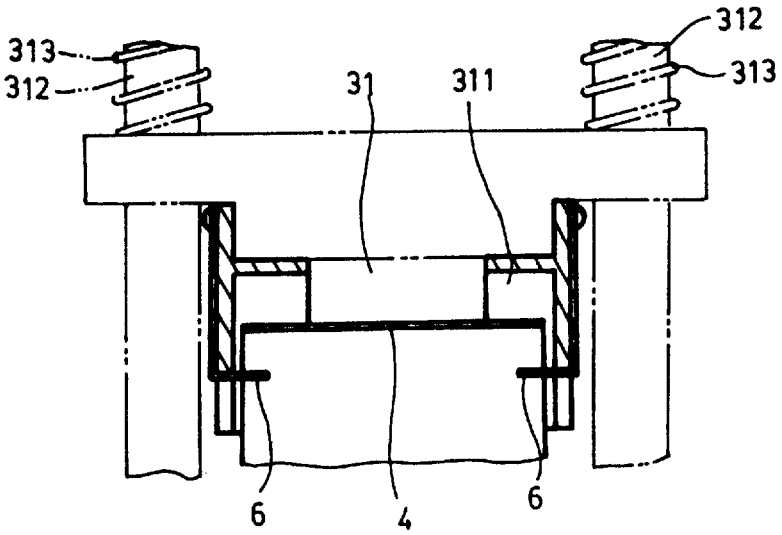
FIG. 5 is a sectional view showing that the paper tape is fed in along the rail of the present invention.
Figure 6:
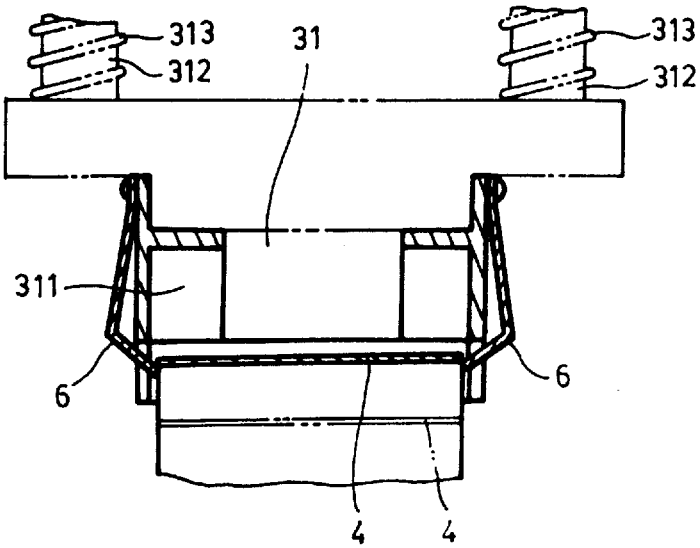
FIG. 6 is a sectional view showing that the paper tape is retrieved from the rail of the present invention.

The tape guiding device 3 mainly includes an upper guiding block 31 and two lower guiding blocks 32 disposed on two sides thereof. The upper and lower guiding blocks 31, 32 are arranged into a U-shaped pattern. The upper guiding block 31 is fixed on upper portion of inner side of the housing 1. The lower guiding blocks 32 are respectively secured to two sides of the platform 21 and spaced from the upper guiding block 31. The bill compressing/sealing mechanism 2 serves to push the lower guiding blocks 32 to ascend or descend. The inner sides of the upper and lower guiding blocks 31, 32 are respectively formed with inner channels 311, 321 for a laminated high strength paper tape 4 to travel therein. Two L-shaped resilient plates 6 are respectively secured to two sides of the inner channels 311, 321. The horizontal sections of the resilient plates 6 just cover the upper side of the opening of the channel as shown in FIGS. 5 and 6 to define a clearance. The resilient plates 6 serve to prevent the paper tape 4 from detaching from the guiding blocks during moving. Therefore, the walls of the inner channels 311, 321 and the resilient plates 6 define a rail for the paper tape 4 to travel therewithin.

Two posts 312 are disposed on two sides of upper face of the upper guiding block 31 and two coil springs 313 are respectively fitted around the posts 312 to provide resilience for the upper guiding block 31 during ascending/descending movement. Accordingly, the position of the upper guiding block 31 can be adjusted according to various thicknesses of different bills 7. The upper side of each lower guiding block 32 is disposed with a locating post 322 for fitting into a corresponding post hole 314 of the upper guiding block 31, whereby when the lower guiding block 32 ascends to assemble with the upper guiding block 32, the lower guiding block 32 is guided so as to reliably form the rail for the paper tape 4.

Figure 3:
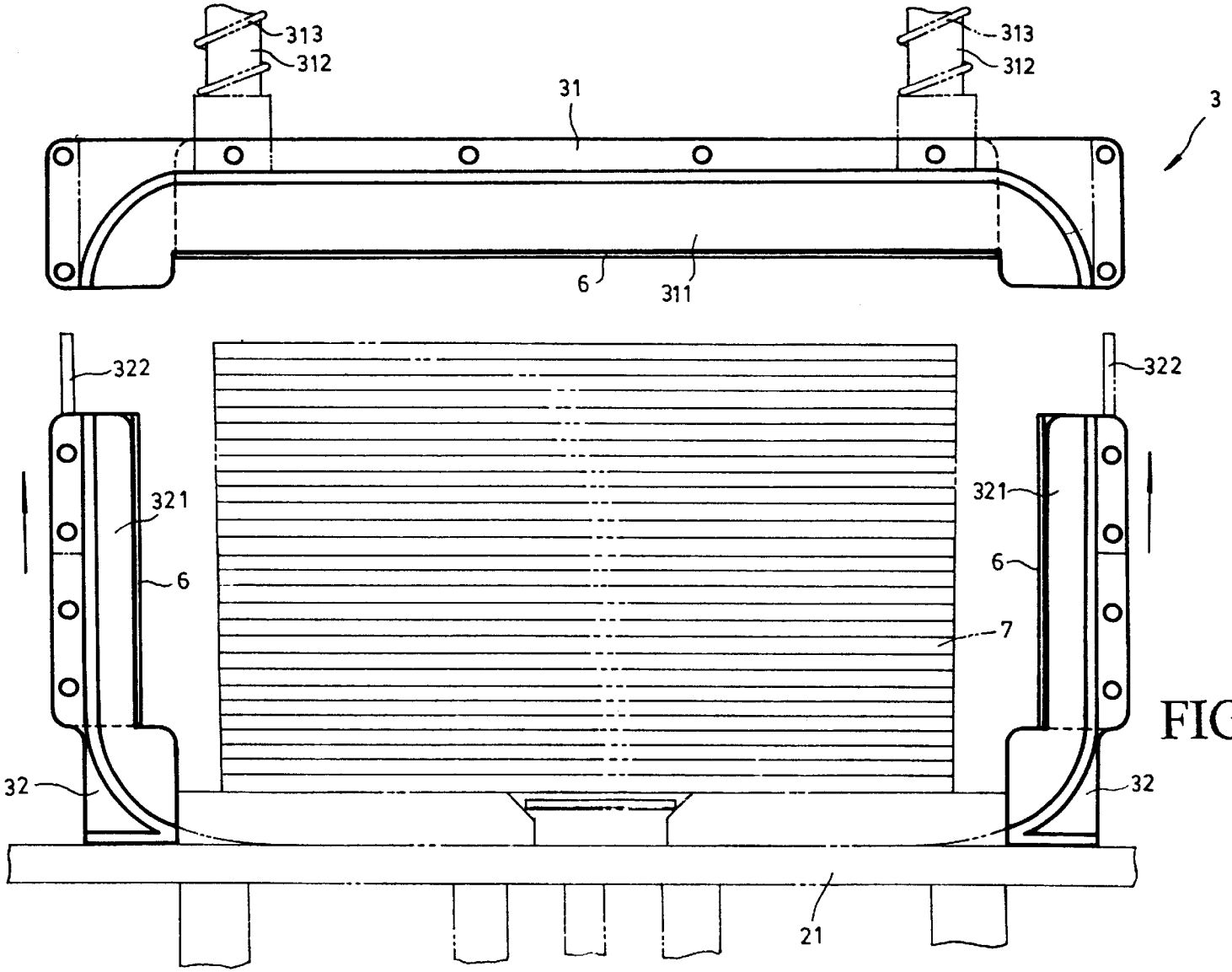
FIG. 3 shows that the upper and lower guiding blocks of the present invention are spaced from each other.
Figure 4:
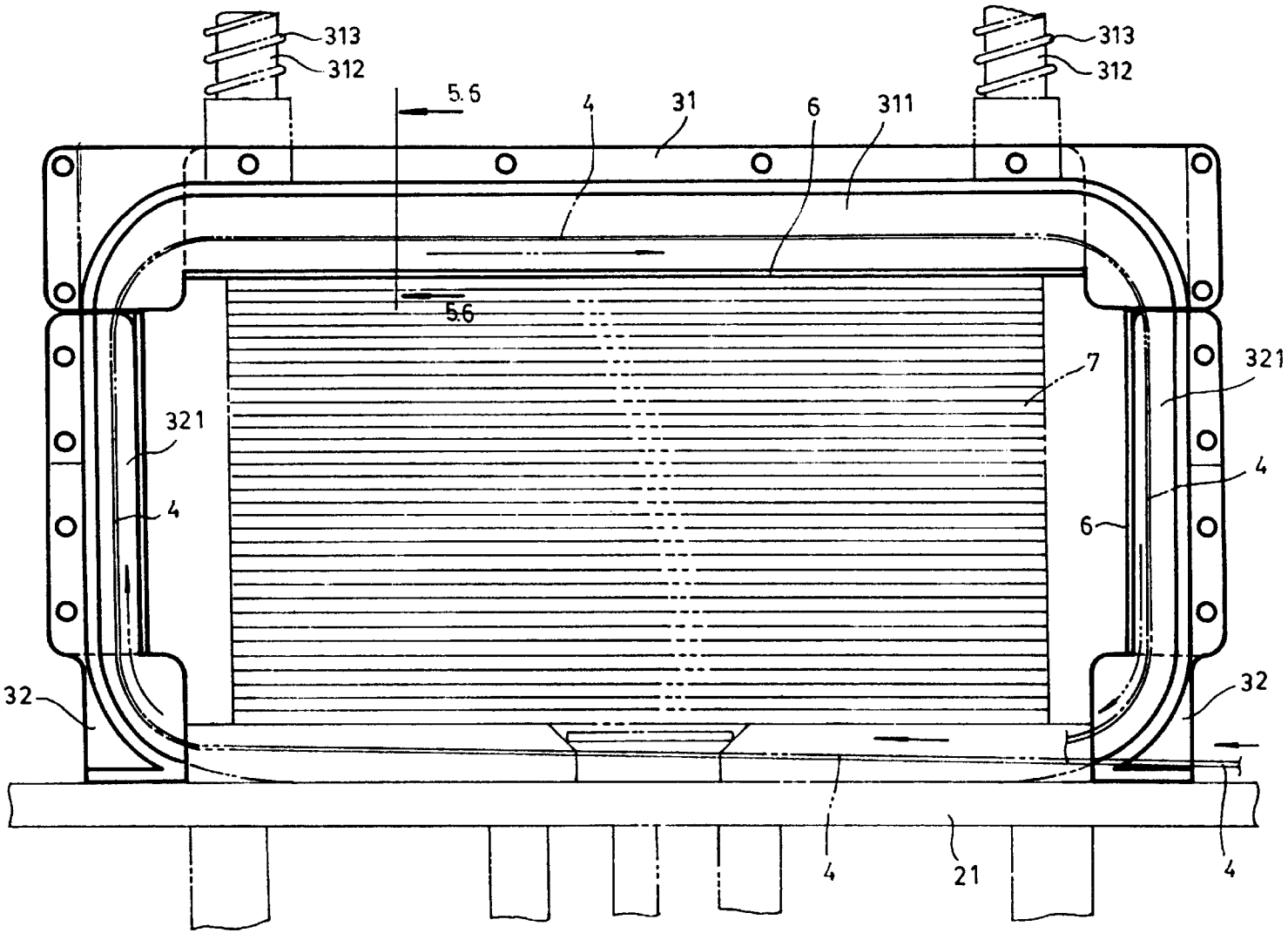
FIG. 4 shows that the upper and lower guiding blocks of the present invention are associated with each other.

Please further refer to FIGS. 3 and 4 which show the operation of the upper and lower guiding blocks 31, 32. First, a stack of bills 7 to be tied are placed on the platform 21 and the bill tying machine is activated, making the bill compressing/sealing mechanism 2 drive the platform 21 to move upward as shown in FIG. 3, whereby the lower guiding blocks 32 are associated with the upper guiding block 31 as shown in FIG. 4. At this time, the tape feeding/retrieving mechanism 5 is activated to push and feed the tape 4 along the the inner channels 311, 321 of the upper and lower guiding blocks 31, 32. The resilient plates 6 serve to restrict the paper tape 4 within the rail during traveling. Please now refer to FIGS. 5 and 6, wherein FIG. 5 shows that the paper tape 4 is fed in, while FIG. 6 shows that the paper tape 4 is retrieved to tie the bills. After the paper tape 4 is circulated through one loop along the inner channels 311, 321 of the upper and lower guiding blocks 31, 32, the head of the paper tape 4 enters the sealing mechanism 2. At this time, the tape feeding/retrieving mechanism 5 is reversed to retrieve the paper tape, whereby the paper tape 4 is detached from the inner channels 311, 312 through the clearance between the L-shaped resilient plates 6. Due to the resilient deformation of the resilient plates 6, the paper tape 4 can easily separate from the resilient plates 6. Moreover, such separation needs no assistant power for opening the resilient plates 6 so that the structure is simpler. After the paper tape 4 separates from the inner channels 311, 312, the tape feeding/retrieving mechanism 5 continuously operates until the paper tape 4 totally ties up the bills. At this time, the tape feeding/retrieving mechanism 5 stops for sealing the paper tape. Simultaneously, the bill compressing/sealing mechanism 2 is reversed to move the platform 21 downward to its home position so as to separate the upper and lower guiding blocks 31, 32 from each other and complete the bill tying operation.

It is to be understood that the above description and drawings are only used for illustrating one embodiment of the present invention, not intended to limit the scope thereof. Any variation and derivation from the above description and drawings should be included in the scope of the present invention.

What is claimed is:

1. A paper tape locating/guiding device of a bill tying machine, comprising a housing, a bill compressing/sealing mechanism and a tape guiding device, wherein the bill compressing/sealing mechanism serves to push a platform to ascend or descend and seal a paper tape, a tape reel being disposed on one side of the housing for the paper tape to wind therearound, a tape feeding/retrieving mechanism being disposed on the other side of the housing, through which the paper tape is passed to enter the tape guiding device, said paper tape locating/guiding device being characterized in that:

the tape guiding device includes an upper guiding block and two lower guiding blocks disposed on two sides thereof, the upper and lower guiding blocks being arranged into a U-shaped pattern, the upper guiding block being fixed on upper portion of inner side of the housing, the lower guiding blocks being respectively secured to two sides of the platform and spaced from the upper guiding block, the bill compressing/sealing mechanism serving to push the lower guiding blocks to ascend or descend, the inner sides of the upper and lower guiding blocks being respectively formed with inner channels for the paper tape to travel therein, two L-shaped resilient plates being respectively secured to two sides of the inner channels, the horizontal sections of the resilient plates just covering the upper side of the opening of the channel to define a clearance for the paper tape to separate from the inner channels therethrough, the walls of the inner channels and the resilient plates defining a rail for the paper tape to travel therewithin.

2. A paper tape locating/guiding device as claimed in claim 1, wherein two posts are disposed on two sides of upper face of the upper guiding block and two coil springs are respectively fitted around the posts to provide resilience for the upper guiding block during ascending/descending movement so that the position of the upper guiding block can be adjusted according to various thicknesses of different bills.

3. A paper tape locating/guiding device as claimed in claim 1, wherein the upper side of each lower guiding block is disposed with a locating post for fitting into a corresponding post hole of the upper guiding block, whereby when the lower guiding block ascends to assemble with the upper guiding block, the lower guiding block is guided so as to reliably form the rail for the paper tape.

* * * * *